United States Patent [19]

Tanaka et al.

[11] Patent Number: 4,556,088

[45] Date of Patent: Dec. 3, 1985

[54] CONTROL ARRANGEMENT FOR WEAVING LOOM OR THE LIKE

[75] Inventors: Shigenori Tanaka, Hachioji; Kouji Tomia, Tama, both of Japan

[73] Assignee: Nissan Motor Co., Ltd., Yokohama, Japan

[21] Appl. No.: 564,691

[22] Filed: Dec. 23, 1983

[30] Foreign Application Priority Data

Dec. 27, 1982 [JP] Japan ..... 57-226592

[51] Int. Cl.[4] ..... D03D 47/36; D03D 51/34

[52] U.S. Cl. ..... 139/452; 139/370.2; 66/132 R; 242/47.01

[58] Field of Search ..... 139/452, 370.2; 242/47.01, 47.12; 66/132

[56] References Cited

U.S. PATENT DOCUMENTS 4,226,379 10/1980 Brouwer et al. ..... 139/452 X 4,381,807 5/1983 Umezawa et al. ..... 139/452

4,407,336 10/1983 Steiner .

FOREIGN PATENT DOCUMENTS

WO 83/04056 11/1983 PCT Int'l Appl.

367191 3/1973 U.S.S.R. ..... 139/370.2

367191 3/1973 U.S.S.R. ..... 139/370.2

*Primary Examiner*—James Kee Chi

*Attorney, Agent, or Firm*—Schwartz, Jeffery, Schwaab, Mack, Blumenthal & Evans

[57] ABSTRACT

A circuit receives a signal indicative of each loop of weft yarn being drawn off a cylindrical storage member and computes based on this data the time required for a given number of loops to be drawn off. The calculation includes an allowance for the time required for mechanical components associated with the releasing of the weft yarn from the storage device to actually reach a weft yarn release position and the time required for the calculation per se to be performed.

8 Claims, 5 Drawing Figures

CONTROL ARRANGEMENT FOR WEAVING LOOM OR THE LIKE

BACKGROUND OF THE INVENTION

1. Field of the Invention

The present invention relates generally to a weaving loom and more specifically to a circuit arrangement for a shuttleless weaving loom which facilitates accurate weft yarn dispensing.

2. Description of the Prior Art

A previously proposed weft yarn storage-supply arrangement for a weaving loom is shown in FIG. 1 of the drawings. In this arrangement weft yarn y is wound onto a drum 2 by a winding arrangement 3 and retained thereon by a retaining device 4. During picking the retaining device 4 is actuated to retract a blocking member 5 from a recess 6 formed in the drum 2 and permit a number of loops of weft yarn y to drawn axially off the drum. The amount of yarn y stored on the drum is controlled by a first sensor 7 which directs a beam of light against the drum and which, in response to the amount of light reflected therefrom, induces suitable energization of the winding arrangement 3 in a manner to maintain a predetermined length of yarn on the drum. The amount of yarn permitted to be released from the drum 2 during each picking operation is controlled by a second sensor 8 which, like the first, directs a beam of light against the drum 2 in a manner that the passage of weft yarn y across the point where the beam impinges on the drum 2, induces a change in the amount of light reflected and thus the output of the light receiving section of the second sensor 8. A control unit 9 is responsive to the output of the second sensor 8 and controls the operation of the retaining device 4.

However, the latter mentioned sensor arrangement has suffered from the drawback that when applied to high speed weaving machines wherein weft yarns having a diameter ranging from tens of microns to hundreds of microns, are exposed to the beam of light for only a few micro seconds, accurate detection of every loop being drawn off the drum becomes extremely difficult. Non-detection of one of more loops of weft yarn y being off the storage drum 4 of course invites an inevitable malfunction of the loom.

Further with this arrangement, even though the time for which the weft yarn is drawn off the storage drum arrangement is closely related to the actual weaving phase, the weft yarn withdrawing speed varies with the injection pressure, width of the fabric being woven, the type of thread being picked the speed at which the loom is being operated, etc., rendering it impossible to automatically set the thread retaining device actuation timing based on a predetermined weft yarn withdrawing speed. Viz., implementation of this type of control leads to the situation wherein the retaining device 4 tends to be actuated either too early or too late.

A full description of the above mentioned arrangement may be found in Japanese Patent Application Provisional publication No. Sho 57-29640 or corresponding U.S. Pat. No. 4,407,336 issued in the name of Steiner on Oct. 4, 1983.

SUMMARY OF THE INVENTION

It is an object of the present invention to provide a control arrangement via which the amount of thread such as weft yarn extracted from a storage device may be accurately predicted based on one or more sensed operating parameters and which accordingly finds utility in high speed weaving looms.

In brief, the invention features a circuit which receives a signal indicative of each loop of weft yarn being drawn off a cylindrical storage member and computes, based on this data, the time at which a retaining device should be controlled to terminate the release of loops of yarn from the storage member. The calculation includes an allowance for the time require for mechanical components associated with the releasing of the weft yarn from the storage device to actually reach a weft yarn release position and the time require for the calculation per se to be performed.

More specifically, the present invention takes the form of a device comprising a source of thread, a storage member onto which a plurality of loops of thread are wound for temporary storage prior use, an apparatus which draws off thread from said temporary storage member when energized, a first sensor for sensing the energization of said apparatus and outputting a signal indicative thereof, a retaining device for selectively permitting thread to be drawn off said temporary storge member, a second sensor for sensing the removal of each loop of thread removed from said storage member and outputting a signal indicative thereof, a circuit operatively connected with said first sensor, said second sensor and said retaining device, said circuit including means responsive to the signals outputted by said first and second sensors for computing the time for which said retaining device should be operated to permit loops of thread to be removed from said storage member.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
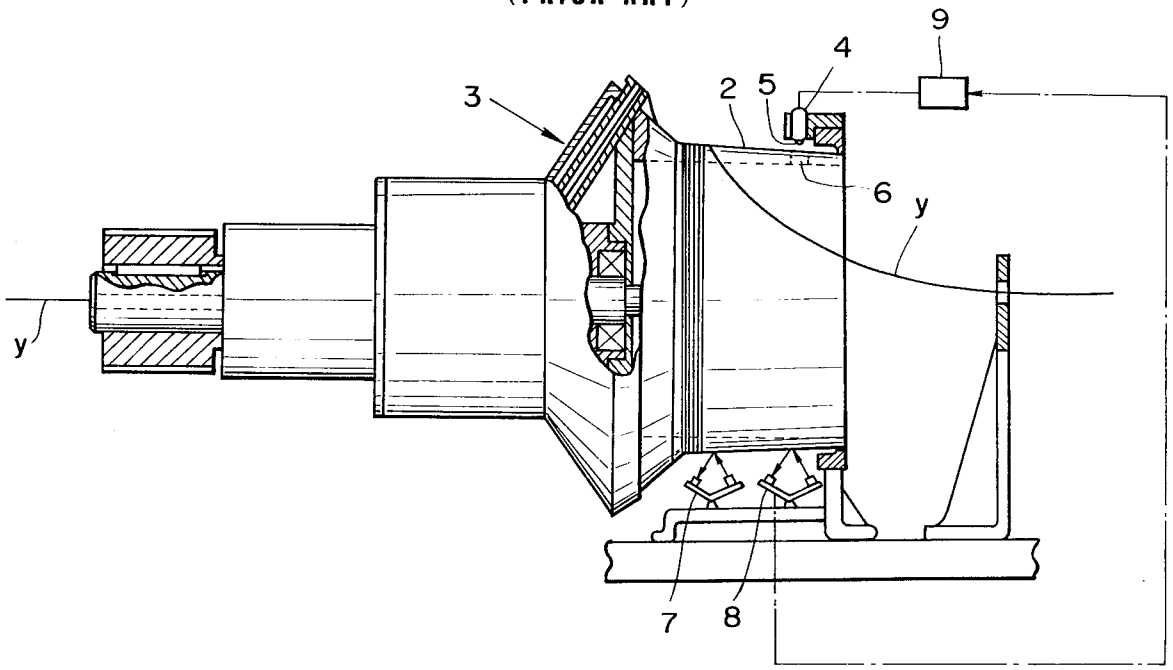
FIG. 1 (PRIOR ART)
FIG. 1 shows the prior art arrangement discussed briefly in the opening paragraphs of the present application.
Figure 2:
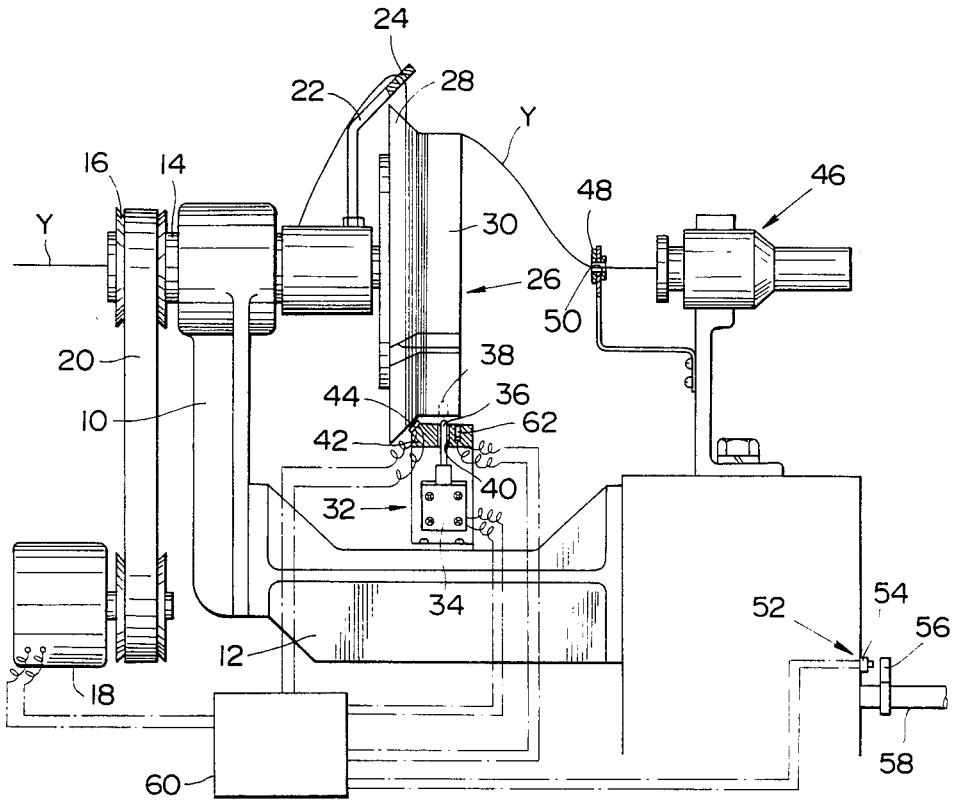
FIG. 2 is an elevational view of a weaving loom to which the present invention is applied.
Figure 3:
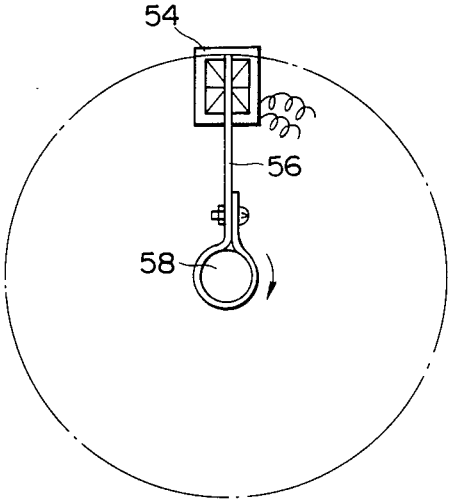
FIG. 3 is a front elevational of a proximity switch arrangement forming part of the loom shown in FIG. 2.
Figure 5:
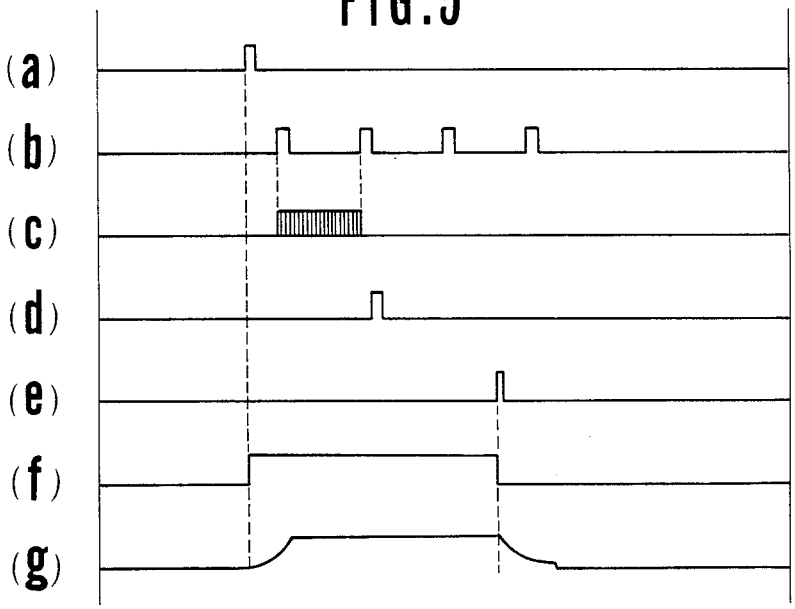
FIG. 5 is a timing chart showing the signals inputted to and outputted by the various elements shown in FIG. 4.

Turning now to FIG. 2 a loom arrangement to which the present invention may be applied is shown. In this arrangement a mounting bracket 10 forming part of a weaving loom frame 12 rotatably supports a hollow shaft 14 through which a weft yarn y is fed. One end of the shaft 14 is provided with a pulley 16 which is operatively connected with an electric motor 18 by a V-belt or the like 20. The other end of the shaft 14 is provided with an arm 22. This arm, as shown, is provided with an aperture 24 near the free end thereof through which the weft yarn y is threaded. It will be noted that the shaft 14 is provided with suitable apertures or through holes (not shown for simplicity of illustration) through which the weft yarn may be fed to the arm.

A temporary storage drum 26 is rotatably mounted on the end of the shaft through suitable roller bearings or the like. This drum is held stationary by weights or magnets (not shown) and further constructed of three or more segments which permit the diameter thereof to be varied and therefore the adjustment of the length of each loop of yarn stored thereon.

The drum 26 is also formed with a frusto-conical section 28 which is arranged with respect to the arm so that upon energization of the motor 18 the arm 22 rotates about the drum 26 to wind loops of weft yarn thereonto. The frusto-conical section 28 serves to induce the newly wound on weft yarn loops to slide along the drum toward a section 30 thereof, which tapers slightly in a direction away from section 28, during operation of the loom.

Located adjacent the periphery of the drum is a retaining device generally denoted by the numeral 32. As shown, this device includes an actuator 34 and a plunger 36 which is normally projected in a manner to be received in a recess 38 formed in the slightly tapered section 30 of the drum and thus prevent any of the loops of yarn y wound on the drum 26 from being removed therefrom. The plunger 36 is arranged to project through an aperture 40 formed in a cover 42 on which a weft yarn sensor 44 is mounted. Upon energization of the actuator 34 the plunger 36 is retracted into the aperture formed in the cover 42.

In this arrangement the weft yarn sensor 44 is arranged to emit a beam of light which impinges on the frusto-conical section 28 of the drum and which senses the presence of a predetermined amount of the weft yarn y stored thereon via either one of (a) using a drum having a highly reflective surface and detecting the reduction in reflection caused by the loops of weft yarn, or (b) using a non-reflective drum and sensing the increase in reflection induced by the weft yarns intercepting and reflecting the beam. The selection of the above mentioned alternatives of course is made in view of the colour and texture of the yarn being used in the loom.

A picking device generally denoted by the numeral 46 is mounted on the frame 12 in a manner to be essentially coaxial with the shaft 14 and drum 26. Interposed between the picking device 46 and the drum 26 is a guide 48. This guide is formed with an aperture 50 the center of which is essentially coaxial with the drum.

A proximity switch arrangement 52 is mounted on the loom frame. This switch comprises a stationary member 54 which includes therein a "Hall effect" switch or the like, and a movable element 56 fixed on a main shaft 58 of the loom. The movable member 56 is arranged to pass by the stationary member 54 either at, or in a timed relation with, the picking operation of the loom. The output of this switch is fed to a control unit 60 which also receives the output of the sensor 44.

A third sensor 62 is mounted on the cover 42. This sensor includes a light emitting section and light receiving section. The construction of this sensor 62 is such that the beam produced by the light emitting portion is reflected by the weft yarn as it slides, in this particular embodiment, over the periphery of the uniform diameter section 30 as it is drawn off the drum 26 and travels toward the guide 48. It should be noted that this sensor may be located in other suitable positions along the path traversed by the weft yarn as it travels toward the picking device 46. One example of same is given in the applicant's copending Japanese Patent Application No. Sho 57-217055.

Figure 4:
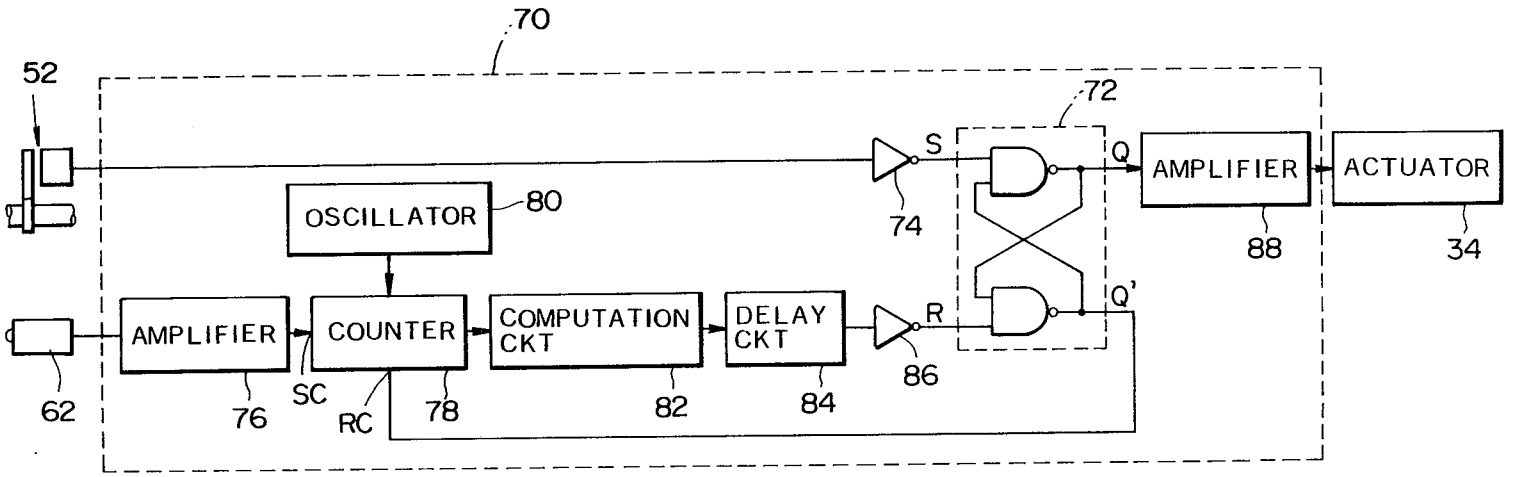
FIG. 4 is a circuit in block diagram form showing an embodiment of the present invention.

A control circuit 70 (FIG. 4) forming part of the control unit 60, receives inputs from the proximity switch 52 and the sensor 62. This circuit includes a flip flop circuit 72 which receives the output of the proximity switch 52 on its "S" (set) terminal via a NOT circuit 74. The circuit further includes an amplifier 76 which receives and suitably modifies the output of the sensor 62. The output of this amplifier is fed to the SC (set count) terminal of a counter 78 which also receives a clock pulse input from an oscillator 80. The output of the counter 78 is fed the "R" (reset) terminal of the flip flop 72 via a computation circuit 82, a delay circuit 84 and a NOT circuit 86. The signal appearing on the "Q" output of the flip flop 72 is, as shown, fed to an amplifier 88 which suitably boosts the signal to a level suitable for energizing the actuator 34. The "Q'" terminal of the flip flop 72 is fed to the RS terminal of the counter 78 to reset same.

With this arrangement upon the proximity switch 52 sensing the initiation of a picking operation (see chart 5 (a)) the flip flop 72 is set by the leading edge of the pulse transmitted to the "S" terminal thereof to produce a high level signal on its "Q" output (see chart 5 (f)). This of course energizes the actuator 34 whereby the plunger 36 reaches a fully retracted position with a given delay as shown in chart 5 (g). Following sufficient retraction of the plunger 36 loops of weft yarn y are permitted to be drawn off the drum 26. The sensor 62 senses the passage of the yarn y therepast and outputs pulses (via the amplifier 76) as shown in chart 5 (b). The counter 78 is set by the leading edge of the first pulse produced by the sensor 62 whereby the counter 78 counts up under the influence of the input from the oscillator 80 until the leading edge of the next pulse. The output of the counter 78 (chart 5 (c)) is fed to the computation circuit 82 which takes the data indicating the time T required for one loop of weft yarn y to be taken off the drum 26, multiplies same by a predetermined constant A (for example the number of loops required minus 1), substracts the sum of the time required to perform the calculation per se ($t_1$) and the rise time of the actuator ($t_2$). Viz., the computation circuit calculates:

$$A \times T - (t_1 + t_2).$$

The result of the calculation is used to trigger the delay circuit 84 which upon the expiry of the calculated period issues a pulse (see chart 5 (e)) which resets the flip flop 72 so that the signal appearing on the Q terminal falls to a low level and that appearing on the Q' terminal rises to a high level clearing the counter 78 in readiness for the next picking cycle.

It will be appreciated that the functions performed by the above described control circuit can also be carried out by a microprocessor which can be programmed to, if desired advantageous, accept only data which falls within a predetermined range. Viz., ignore data which is approximately double the normal time required for the extraction of one loop from the storage drum; and/or keep a predetermined amount of data stored so as to ascertain with precision the time required for one loop to be taken off the storage arrangement.

In summary, the present invention features an arrangement wherein the time interval between two successive loops of weft yarn being drawn off the storage drum arrangement is determined and used as a basis for estimating the length of weft yarn picked and for calculating the time at which the weft yarn retaining device should be controlled to terminate the release of weft yarns. This permits the variation in traction force produced by the picking device, the length of yarn required, the type of yarn being picked, etc., to be taken into account on a cycle to cycle basis and therefore accurate control of the yarn release irrespective of minor fluctuations in operational parameters and the like.

What is claimed is:

1. In a device a source of thread;

a storage member onto which a plurality of loops of thread are wound for temporary storage prior use;

an apparatus which draws off thread from said temporary storage member when energized;

a first sensor for sensing the energization of said apparatus and outputting a signal indicative thereof;

a retaining device for selectively permitting thread to be drawn off said temporary storage member;

a second sensor for sensing the removal of each loop of thread removed from said storage member and outputting a signal indicative thereof;

a circuit operatively connected with said first sensor, said second sensor and said retaining device, said circuit including means responsive to the signals outputted by said first and second sensors for computing the time for which said retaining device should be operated to permit loops of thread to be removed from said storage member.

2. A weaving device, comprising:

a source of thread;

a storage member onto which a plurality of loops of thread are wound for temporary storage prior to use;

an apparatus which draws off thread from said temporary storage member when energized;

a first sensor for sensing the energization of said apparatus and outputting a signal indicative thereof;

a retaining device for selectively permitting thread to be drawn off said temporary storage member;

a second sensor for sensing the removal of each loop of thread removed from said storage member and outputting a signal indicative thereof;

a circuit operatively connected with said first sensor, said second sensor and said retaining device, said circuit including means responsive to the signals outputted by said first and second sensors for computing the time for which said retaining device should be operated to permit loops of thread to be removed from said storage member;

wherein said signal responsive means comprises:

a circuit which measures the time required for one loop of thread to be removed from said storage member;

a computation circuit for multiplying the time measured by said time measuring circuit by a predetermined constant and subtracting a value equal to the sum of the time required for the calculation per se to be carried out and the rise time of said retaining device; and a delay circuit which upon the expiration of the period calculated by said computation circuit issues a signal which causes said retaining device to assume a state in which thread is prevented from being drawn off said storage member.

3. A device as claimed in claim 2, wherein said time measuring circuit takes the form of a counter which receives a clock pulse from an oscillator and which is set by an output of said second sensor to count up under the influence of said osciallator until a subsequent pulse is outputted by said second sensor.

4. A device as claimed in claim 2, wherein said control circuit includes a flip flop circuit which set by the output of said first sensor to cause said retaining device to assume a state wherein thread can be removed from said storage member and which is reset by the output of said delay circuit to cause said retaining device to assume a state wherein thread is prevented from being drawn off said storage member.

5. A device as claimed in claim 4, wherein said flip flop is connected with said counter in a manner to clear same upon the output of said delay circuit being fed to said flip flop.

6. A device as claimed in claim 2, wherein said storage member takes the form of a variable diameter drum which permits the adjustment of the length of each loop of thread stored thereon.

7. A device as claimed in claim 2, further comprising means for sensing the amount of thread stored on said drum and for winding on loops of thread in the event that the amount of thread is sensed being below a predetermined level.

8. A device as claimed in claim 2, wherein said device is a weaving loom and said first sensor is a proximity switch responsive to the movement of a main shaft of said loom.

* * * * *